US006143703A

United States Patent [19]

Cheung et al.

[11] Patent Number: 6,143,703

[45] Date of Patent: Nov. 7, 2000

[54] BOTANICAL OILS AS BLOOMING AGENTS IN GERMICIDAL HARD SURFACE CLEANING COMPOSITIONS

[75] Inventors: Tak Wai Cheung, Princeton Junction; Dennis Thomas Smialowicz, Waldwick, both of N.J.

[73] Assignee: Reckitt Benckiser Inc., Wayne, N.J.

[21] Appl. No.: 09/265,667

[22] Filed: Mar. 10, 1999

[30] Foreign Application Priority Data

Apr. 14, 1998 [GB] United Kingdom ..... 9807661

[51] Int. Cl.[7] ..... C11D 3/50

[52] U.S. Cl. ..... 510/101; 510/384; 510/416

[58] Field of Search ..... 510/101, 384, 510/416

[56] References Cited

U.S. PATENT DOCUMENTS

| | | | |
|---|---|---|---|
| 4,336,151 | 6/1982 | Like et al. | 252/106 |
| 4,455,250 | 6/1984 | Frazier | 252/106 |
| 4,597,887 | 7/1986 | Colodney et al. | 252/106 |
| 5,403,587 | 4/1995 | McCue et al. | 424/195.1 |
| 5,591,708 | 1/1997 | Richter | 510/463 |
| 5,610,189 | 3/1997 | Whiteley | 514/557 |
| 5,629,280 | 5/1997 | Richter et al. | 510/463 |
| 5,939,374 | 8/1999 | Richter et al. | 510/384 |

FOREIGN PATENT DOCUMENTS

| | | | |
|---|---|---|---|
| 688 787 A5 | 3/1998 | Switzerland | A01N 65/00 |
| WO93/17558 | 9/1993 | WIPO | A01N 65/00 |
| WO97/06230 | 2/1997 | WIPO | C11D 1/65 |
| WO97/18285 | 5/1997 | WIPO | C11D 1/68 |
| WO98/02044 | 1/1998 | WIPO | A01N 65/00 |

OTHER PUBLICATIONS

Copy of PCT Search Report dated Jul. 21, 1999 for PCT Application No. PCT/US99/05961.

Copy of GB Search Report for GB Application No. 9807661.5 dated Jul. 9, 1998

*Primary Examiner*—John R. Hardee

*Attorney, Agent, or Firm*—Fish & Richardson P.C.

[57] ABSTRACT

The present invention provides aqueous concentrated liquid disinfectant compositions which blooms when added to a larger volume of water which comprise:

botanical oil constituent;

a germicide constituent, preferably a germicidal cationic surfactant, and most preferably a quaternary ammonium compound having germicidal properties;

organic solvent constituent;

at least one botanical oil solubilizing surfactant, preferably selected from amine oxides, alkylpolyoxycarboxylates and alkylarylpolyoxycarboxylates;

and further conventional optional constituents including chelating agents, coloring agents, light stabilizers, fragrances, thickening agents, hydrotropes, pH adjusting agents, pH buffers one or more detersive surfactant constituents and the like. The concentrate compositions do not include a pine oil.

13 Claims, No Drawings

BOTANICAL OILS AS BLOOMING AGENTS IN GERMICIDAL HARD SURFACE CLEANING COMPOSITIONS

The present invention relates to disinfectant compositions. More particularly the present invention relates to concentrated liquid disinfectant compositions which are normally diluted in a larger volume of water to form a working solution therefrom, and which exhibit a blooming effect when diluted.

Blooming is a property exhibited by dilutable compositions such as known cleaning compositions, specifically pine-oil type cleaning compositions which contain a significant amount (generally at least about 5% and more) of pine oil which includes a significant proportion of terpene alcohols. Certain phenolic disinfectant compounds, such as LYSOL disinfectant concentrate (Reckitt & Colman, Inc., Montvale N.J.) also exhibit such a blooming property. Blooming may be characterized as the formation of milky, creamy or cloudy appearance which is manifested when a dilutable composition is added to a larger volume or quantity of water. Blooming is an important characteristic from a consumer standpoint as it provides a visual indicator and impression to the consumer that the concentrated product contains active cleaning and/or disinfecting constituents which are released upon addition of the concentrate to a volume of water. Such is an important visual indicator of apparent efficacy of a concentrated product.

While presently commercially available materials have advantageous features, they are not without their attendant shortcomings as well. For example, the use of pine oil, and its pungent characteristic odor is frequently not desired. A further disadvantage is that the use of significant amounts of pine oil in a composition is desirably avoided as the pine oil is know to deposit a sticky residue on hard surfaces, which is particularly undesirable from a consumer standpoint. Also, many such compositions frequently are directed to providing a cleaning effect, and do not provide an appreciable sanitizing effect.

It has now been found that it is now possible to produce certain concentrate compositions utilizing these selected constituents in particular formulations which provide blooming type cleaning compositions in a concentrated liquid form which provide both a germicidal effect and a good blooming effect, and which do not include pine oils. The "blooming" observed may be described as the change of the water's appearance from essentially colorless and transparent to that of a milky white or milky yellowish white, cloudy appearance. This effect is also sometimes referred to as the "break". Such blooming is a highly desirable in blooming type cleaning compositions as consumer/end user expectations associate cleaning effectiveness with the extent and degree of this blooming upon formation of a cleaning composition. Such blooming is particularly desirable in compositions where the blooming characteristic in an aqueous dilution is long lasting.

Accordingly it is an object of the invention to provide an aqueous concentrated liquid disinfectant composition which blooms when added to a larger volume of water which comprises the following constituents:

- botanical oil constituent;
- a germicide constituent, preferably a germicidal cationic surfactant, and most preferably a quaternary ammonium compound having germicidal properties;
- organic solvent constituent;
- at least one botanical oil solubilizing surfactant, preferably selected from amine oxides, alkylpolyoxycarboxylates and alkylarylpolyoxycarboxylates;

- optionally but desirably at least one optional constituent selected from: chelating agents, coloring agents, light stabilizers, fragrances, thickening agents, hydrotropes, pH adjusting agents, pH buffers, one or more detersive surfactant constituents particularly non-ionic and amphoteric surfactants, as well as others known the art. The one or more optional constituents are selected to be present, and are included in amounts which do not undesirably affect the overall blooming characteristics of the present inventive compositions.

The compositions according to the invention may also optionally, but in some cases very desirably, also include a biphenyl solvent constituent which aids or imparts a blooming type characteristic to the compositions when added to a larger volume of water.

In preferred embodiments the concentrate compositions provide excellent initial blooming characteristics in 'as mixed' dilutions with water.

It is a further object of the invention to provide such a concentrated liquid disinfectant composition wherein the composition exhibits a blooming effect when diluted in a larger volume of water.

It is a yet further object of the invention to provide such a concentrated liquid disinfectant composition wherein the composition exhibits a germicidal effect in both its concentrated form, and in an aqueous diluted form.

It is a still further object of the invention to provide such a concentrated liquid disinfectant composition which in a diluted form provides disinfection of surfaces wherein the presence of gram positive type pathogenic bacteria such as *Staphylococcus aureus*, and/or the presence of gram negative type pathogenic bacteria such as *Salmonella choleraesuis* and/or *Pseudomonas aeruginosa* is suspected.

It is among the further object of the invention to provide such a concentrated liquid disinfectant composition wherein the composition exhibits good long term stability, i.e., shelf stability in its concentrated form.

As an essential constituent in the concentrate compositions according to the present invention there are present one or more botanical oils, sometimes also referred to as "essential oils" which are useful in providing a blooming effect. By way of non-limiting example these include one or more of: Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Bomeol Flakes (China), Camphor oil, White, Camphor powder synthetic technical, Canaga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methhyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen. Each of these botanical oils is commercially available. As noted previously, the inventive compositions do not include pine oil which is known to the prior art to provide blooming effects.

Particularly preferred oils include those which are exemplified by the examples, following, and include: peppermint oil, and lavender oil.

These may be commercially obtained from a variety of suppliers including: Givadan Roure Corp. (Clifton, N.J.); Berje Inc. (Bloomfield, N.J.); BBA Aroma Chemical Div. of Union Camp Corp. (Wayne, N.J.); Firmenich Inc. (Plainsboro N.J.); Quest International Fragrances Inc. (Mt. Olive Township, N.J.); Robertet Fragrances Inc. (Oakland, N.J.).

These oils may be present in the compositions in any amounts which are effective in providing a desirable blooming effect. Generally amounts from as little as 0.001% wt. to amounts of 20% wt. are useful, based on the total weight of the concentrated liquid disinfectant composition. More preferably these oils are present in amounts of from 0.01–15% wt., still more preferably 0.1–15% wt., and most preferably in amounts of from 1–10% wt. Of course, more a plurality of these oils may be used.

The inventive compositions include a germicide constituent which is effective against gram positive bacteria or gram negative bacteria, but preferably against both.

The concentrate compositions according to the invention include a germicide constituent which is found to provide an antibacterial or antimicrobial function. Desirably the germicide constituent is at least one cationic surfactant which is found to provide a broad antibacterial or sanitizing function. Any cationic surfactant which satisfies these requirements may be used and are considered to be within the scope of the present invention, and mixtures of two or more cationic surface active agents, viz., cationic surfactants may also be used. Cationic surfactants are well known, and useful cationic surfactants may be one or more of those described for example in *McCutcheon's Detergents and Emulsifiers*, North American Edition, 1982; *Kirk-Othmer, Encyclopedia of Chemical Technology*, 3rd Ed., Vol. 22, pp. 346–387, the contents of which are herein incorporated by reference.

Examples of preferred cationic surfactant compositions useful in the practice of the instant invention are those which provide a germicidal effect to the concentrate compositions, and especially preferred are quaternary ammonium compounds and salts thereof, which may be characterized by the general structural formula:

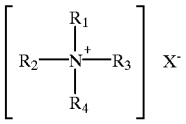

where at least one of $R_1$, $R_2$, $R_3$ and $R_4$ is a alkyl, aryl or alkylaryl substituent of from 6 to 26 carbon atoms, and the entire cation portion of the molecule has a molecular weight of at least 165. The alkyl substituents may be long-chain alkyl, long-chain alkoxyaryl, long-chain alkylaryl, halogen-substituted long-clhain alkylaryl, long-chain alkylphenoxyalkyl, arylalkyl, etc. The remaining substituents on the nitrogen atoms other than the abovementioned alkyl substituents are hydrocarbons usually containing no more than 12 carbon atoms. The substituents $R_1$, $R_2$, $R_3$ and $R_4$ may be straight-chained or may be branched, but are preferably straight-clained, and may include one or more amide, ether or ester linkages. The counterion X may be any salt-forming anion which permits water solubility of the quaternary ammonium complex.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide, ether or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quaternary amnonium compounds which act as germicides and which are be found useful in the practice of the present invention include those which have the structural formula:

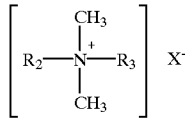

wherein $R_2$ and $R_3$ are the same or different $C_8$–$C_{12}$alkyl, or $R_2$ is $C_{12-16}$alkyl, $C_{8-18}$alkylethoxy, $C_{8-18}$alkylphenolethoxy and $R_3$ is benzyl, and X is a halide, for example chloride, bromide or iodide, or is a methosulfate anion. The alkyl groups recited in $R_2$ and $R_3$ may be straight-chained or branched, but are preferably substantially linear.

Particularly useful quaternary germicides include compositions which include a single quaternary compound, as well as mixtures of two or more different quaternary compounds. Particularly useful quaternary germicides include which are described as being a blend of alkyl dimethyl benzyl ammonium chlorides; BARDAC® 205M, BARDAC® 2050, BARDAC® 2080, BARDAC® 2250, BTC® 812, BTC® 818 and BTC® 1010 which are described as being based on dialkyl($C_8$–$C_{10}$)dimethyl ammonium chloride; BARDAC® 2250 and BARDAC® 2280 or BTC® 1010 which are described as being a composition which includes didecyl dimethyl ammonium chloride; BARDAC® LF and BARDAC® LF 80 which are described as being based on dioctyl dimethyl ammonium chloride; BARQUAT® MB-50, BARQUAT® MB-80, BARQUAT® MX-50 BARQUAT® MX-80, BARQUAT® OJ-50, BARQUAT® OJ-80, BARDAC® 208M, HYAMINE® 3500, HYAMINE® 3500-NF, BTC® 50, BTC® 824, BTC® 835, BTC® 885, BTC® 2565, BTC® 2658, BTC® 8248 or BTC® 8358 each described as being based on alkyl dimethyl benzyl ammonium chloride (benzalkonium chloride); BARQUAT® 4250, BARQUAT® 4280, BARQUAT® 4250Z, BARQUAT® 4280Z, BTC® 471, BTC® 2125, or BTC® 2125M each described as being a composition based on alkyldimethylbenzyl ammonium chloride and/or alkyldimethylethylbenzyl ammonium chloride; BARQUAT® MS-100 or BTC® 324-P-100 each described as being based on myristyldimethylbenzyl ammonium chloride; HYAMINE® 2389 described as being based on methyldodecylbenzyl ammonium chloride and/or methyldodecylxylene-bis-trimethyl ammonium chloride; HYAMINE® 1622 described as being an aqueous solution of benzethonium chloride; as well as BARQUAT® 1552 or BTC® 776 described as being based on alkyl dimethyl benzyl ammonium chloride and/or dialkyl methyl benzyl ammonium chloride, BARQUAT® 50-MAB described as being based on alkyldimethylethyl ammonium bromide and LONZABAC® -12.100 described as being based on an alkyl tertiary amine. Polymeric quaternary ammonium salts based on these monomeric structures are also considered desirable for the present invention. One example is POLYQUAT® described as being a 2-butenyldimethyl ammonium chloride polymer. (Each of these recited materials are presently commercially available from Lonza, Inc., Fairlawn, N.J. and/or from Stepan Co., Northfield Ill.)

The germidical constituent may be present in any effective amount, but generally need not be present in amounts in excess of about 15% wt. based on the total weight of the concentrate composition. The preferred germicidal cationic surfactant(s) may be present in the concentrated liquid disinfectant compositions in amounts of from about 0.001% by weight to up to about 15% by weight, preferably about 0.01–8% by weight, most preferably in amount of between 0.5–6% by weight.

A further constituent according to the invention is an organic solvent which is present in addition to the botanical oil which is itself known to be an organic solvent and assists in improves the dispersability and/or miscibility of the botanical oil in water. The organic solvent may also improve the miscibility of further constituents according to the present invention, including any water insoluble or poorly soluble constituents. Many useful organic solvents which are known to be useful in dispersing botanical oil in water may be used; virtually any may be used as long as it does not undesirably disrupt the favorable characteristics of the invention, especially the blooming characteristic. Mixtures of two or more organic solvents may also be used as the organic solvent constituent.

Exemplary useful organic solvents are those which are at least partially water-miscible such as alcohols, water-miscible ethers (e.g. diethylene glycol diethylether, diethylene glycol dimethylether, propylene glycol dimethylether), water-miscible glycol ether (e.g. propylene glycol monomethylether, propylene glycol mono ethylether, propylene glycol monopropylether, propylene glycol monobutylether, ethylene glycol monobutylether, dipropylene glycol monomethylether, diethyleneglycol monobutylether), lower esters of monoalkylethers of ethyleneglycol or propylene glycol (e.g. propylene glycol monomethyl ether acetate) all commercially available from Union Carbide, Dow Chemicals or Hoescht. Mixtures of organic solvents can also be used.

Particularly useful organic solvents include glycols such as alkylene glycols such as propylene glycol, and glycol ethers. Examples of such glycol ethers include those having the general structure R'—O—R"—OH, wherein R' is an alkoxy of 1 to 20 carbon atoms, or aryloxy of at least 6 carbon atoms, and R" is an ether condensate of propylene glycol and/or ethylene glycol having from one to ten glycol monomer units. Examples of such useful glycol ethers include propylene glycol methyl ether, dipropylene glycol methyl ether, tripropylene glycol methyl ether, propylene glycol isobutyl ether, ethylene glycol methyl ether, ethylene glycol ethyl ether, ethylene glycol butyl ether, diethylene glycol phenyl ether, propylene glycol phenol ether, and mixtures thereof. Preferred are ethylene glycol n-butyl ether, diethylene glycol n-butyl ether, propylene glycol and mixtures thereof. Most preferably, the organic solvent constituent includes propylene glycol as the sole glycol or glycol ether present in the composition. Such glycol ethers recited above are presently commercially available from a number of sources including in the DOWANOL™ glycol ether from The Dow Chemical Company, Midland Mich. (USA).

Further particularly useful organic solvents monohydric (straight chained or branched) primary, secondary or tertiary lower aliphatic alcohols, especially $C_1$–$C_6$ aliphatic primary and secondary alcohols, of which isopropanol is particularly preferred.

It has generally been found the addition of only a minimum effective amount which is found to be effective in dispersing or solubilizing the botanical oil constituent and any other aqueous insoluble or poorly soluble constituents in the concentrate compositions is desirably used. Such is due to desire to reduce the amount of volatile organic constituents in the concentrate compositions of the invention, which volatile organic constituents are desirably minimized from an environmental standpoint. The present inventors have found that inclusion of the organic solvent constituent in amounts of about 0.001% by weight to about 50% by weight have been found to be effective to solubilize the botanical oil, as well as in solubilizing other less water soluble constituents present in the concentrate compositions of the invention. Preferably, the organic solvent constituent is present in amounts of from 0.1–40% by weight, and most preferably from about 0.1–35% by weight.

Additionally the inventor has found the according to certain preferred embodiments the organic solvent constituent, comprises, and in certain especially preferred embodiments consist essentially of, an alkylene glycol such as propylene glycol, with a monohydric lower aliphatic alcohol such as a $C_1$–$C_6$ aliphatic primary or $C_1$–$C_6$ aliphatic secondary alcohol, especially isopropyl alcohol, and further a higher aliphatic primary or secondary alcohol such as a $C_8$–$C_{14}$ alcohol, especially lauryl alcohol. Desirably, the alkylene glycol constituent is equal in an amount at least equal to the total amount of both the $C_1$–$C_6$ alcohol and the $C_8$–$C_{14}$ alcohol.

The organic solvent constituent may be present in the concentrated liquid disinfectant compositions in amounts of from about 0.001% by weight to up to about 50% by weight, preferably about 0.1–40% by weight, most preferably in amount of between 0.1–35% by weight. Of course a mixture of organic solvents may be used.

The concentrate compositions of the invention further comprise at least one botanical oil solubilizing surfactant. Particularly useful as the botanical oil solubilizing surfactant are nonionic surfactant compositions based on amine oxides.

One general class of useful amine oxides include alkyl di (lower alkyl) amine oxides in which the alkyl group has about 10–20, and preferably 12–16 carbon atoms, and can be straight or branched chain, saturated or unsaturated. The lower alkyl groups include between 1 and 7 carbon atoms. Examples include lauryl, dimethyl amine oxide, myristyl dimethyl amine oxide, and those in which the alkyl group is a mixture of different amine oxide, dimethyl cocoamine oxide, dimethyl (hydrogenated tallow) amine oxide, and myristyl/palmityl dimethyl amine oxide.

A further class of useful amine oxides include alkyl di (hydroxy lower alkyl) amine oxides in which the alkyl group has about 10–20, and preferably 12–16 carbon atoms, and can be straight or branched chain, saturated or unsaturated. Examples are bis(2-hydroxyethyl) cocoamine oxide, bis(2-hydroxyethyl) tallowamine oxide; and bis(2-hydroxyethyl) stearylamine oxide.

Further useful amine oxides include those which may be characterized as alkylamidopropyl di(lower alkyl) amine oxides in which the alkyl group has about 10–20, and preferably 12–16 carbon atoms, and can be straight or branched chain, saturated or unsaturated. Examples are cocoamidopropyl dimethyl amine oxide and tallowamidopropyl dimethyl amine oxide; and Additional useful amine oxides include those which may be referred to as alkylmorpholine oxides in which the alkyl group has about 10–20, and preferably 12–16 carbon atoms, and can be straight or branched chain, saturated or unsaturated.

Useful amine oxides may be obtained from a variety of commercial sources and include for example amine oxides available in the AO series from Tomah Products Inc.; in the AMMONYX series from Stepan Co.; in the BARLOX series from Lonza Inc. (Fairlawn, N.J.), in the RHODAMOX series from Rhone-Poulenc Inc. (Cranbury, N.J.), as well as in the MACKAMINE series of products from McIntyre Group Ltd.

Particularly useful amine oxides for use in the present inventive compositions include AO-728 Special which is described to be a composition containing 50% wt. of bis-(2-hydroxyethyl C12–C15 alkyloxypropyl) amine oxide (Tomah Products Inc., Milton Wis.), and AMMONYX CDO Special described to be cocoamidopropyl dimethyl amine (Stepan Co., Northfield Ill.).

When included in the concentrated liquid disinfectant compositions, the amine oxide constituent is present in amounts of from about 0.001% by weight to up to about 30% by weight, preferably about 1–20% by weight, most preferably in amount of between 12–15% by weight. Of course a mixture of these amine oxide constituents may be used.

A further botanical oil solubilizing constituent which may be included in the concentrate compositions are alkylpolyoxycarboxylates and alkylarylpolycarboxylates. Examplary alkylpolyoxycarboxylates and alkylarylpolycarboxylates include alkyl- and alkylaryl-carboxylates which include those which may be represented by the general formula:

$$R—COO^-M^+$$

wherein R is a straight or branched hydrocarbon chain containing from about 9 to 21 carbon atoms, and which may also include an aromatic ring, especially a phenyl group as part of the hydrocarbon chain, and M is a metal or ammonium ion. Further preferred alkylpolyoxycarboxylates include polyethoxycarboxylates which may be represented by the general formula:

$$R—[—OCH_2CH_2—]_n—CH_2COO^-M^+$$

wherein R is a straight chained or branched hydrocarbon chain which may include an aryl moiety, but is desirably a straight chained or branched hydrocarbon chain; and n is an integer value of from 1–24, and M is a metal or ammonium ion, but is preferably a alkali or alkaline earth metal ion, especially sodium.

Exemplary useful alkylpolyoxycarboxylates and alkylarylpolycarboxylates include those commercially available in the NEODOX series from Shell Chemical Co.; SANDOPAN series from Clariant Inc. (Charlotte, N.C.), as well as in the SURFINE series from Finetex, Inc.

When present in the concentrated liquid disinfectant compositions, the alkylpolyoxycarboxylates or alkylarylpolycarboxylate constituent is included in amounts of from about 0.001% by weight to up to about 20% by weight, preferably about 0.1–10% by weight, most preferably in amount of between 1–5% by weight. Of course a mixture of these constituents may be used.

It is to be understood that the alkylpolyoxycarboxylates and alkylarylpolycarboxylates may be used in the place or, or in conjunction with the amine oxide constituent discussed herein. Also, mixtures of two or more alkylpolyoxycarboxylates and alkylarylpolycarboxylates may be used.

In certain compositions according to the invention, and in accordance with certain specific preferred embodiments, the compositions include a biphenyl solvent constituent, The alkyl biphenyl solvent is one which may be generally represented by the formula

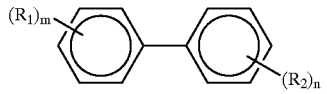

wherein:

$R_1$ is hydrogen or is a lower alkyl radical, preferably a $C_1$–$C_{10}$, but more preferably is a $C_1$–$C_6$ straight chained or branched alkyl radical, $R_2$ is a lower alkyl radical, preferably a $C_1$–$C_{10}$, but more preferably is a $C_1$–$C_6$ straight chained or branched alkyl radical, m is an integer from 1–3 inclusive; and, n is an integer from 1–3 inclusive.

Preferably $R_1$ is hydrogen, m is 1, and $R_2$ has any of the values indicated above. More preferably, $R_1$ is hydrogen and m is 1, and $R_2$ is a $C_1$–$C_6$ straight chained or branched alkyl radical. It is to be understood that mixtures of the compounds indicated above may be used as the biphenyl solvent constituent.

Such alkyl biphenyls are, per se, known to the art, and are described in U.S. Pat. No. 3,787,181. Particularly useful as the alkyl biphenyl solvent are materials presently marketed as NUSOLV ABP solvents (Ridge Technologies Inc., Ridgewood N.J.) described to be a high purity alkyl biphenyls and mixtures thereof, and is also available from Koch Chemical Co. (Corpus Christi, Tex.).

When present in the inventive concentrate compositions, the biphenyl solvent is present in amounts of from about 0.001% by weight to up to about 10% by weight, preferably about 0.1–5% by weight, most preferably in amount of between 0.5–2% by weight. Of course a mixture of these biphenyl solvents may be used.

Water is added in order to provide 100% by weight of the concentrate composition. The water may be tap water, but is preferably distilled and/or deionized water. If the water is tap water, it is preferably appropriately filtered in order to remove any undesirable impurities such as organics or inorganics, especially minerals salts which are present in hard water which may thus interfere with the operation of the other constituents of the invention, as well as any other optional components of the liquid concentrates according to the invention.

Water is added in amounts which are sufficient to form the concentrated compositions which amount is sufficient to ensure the retention of a substantially clear characteristic when produced as a concentrate, but at the same time ensuring good blooming upon the addition of the concentrated composition to a further amount of water, or upon the addition of further water to the concentrate.

Other conventional additives known to the art but not expressly enumerated here may also be included in the compositions according to the invention. By way of non-limiting example without limitation these may include: chelating agents, coloring agents, light stabilizers, fragrances, thickening agents, hydrotropes, pH adjusting agents, pH buffers as well as one or more detersive surfactant constituents particularly non-ionic and amphoteric surfactants. Many of these materials are known to the art, per se, and are described in *McCutcheon's Detergents and Emulsifiers*, North American Edition, 1982; *Kirk-Othmer, Encyclopedia of Chemical Technology*, 3rd Ed., Vol. 22, pp. 346–387, the contents of which are herein incorporated by reference. Mixtures of two or more such surface active agents may be incorporated into the inventive compositions. Such optional, i.e., non-essential constituents should be selected so to have little or no detrimental effect upon the desirable characteristics of the present invention, namely the blooming behavior, cleaning efficacy, disinfectant activity, and low toxicity as provided by the inventive compositions. Generally the total weight of such further conventional additives may comprise up to 20% by weight of a concentrated composition formulation.

Further optional, but advantageously included constituents are one or more coloring agents which find use in modifying the appearance of the concentrate compositions and enhance their appearance from the perspective of a consumer or other end user. Known coloring agents, may be incorporated in the compositions in effective amount to improve or impart to concentrate compositions a desired appearance. Such a coloring agent or coloring agents may be added in any useful amount in a conventional fashion, i.e., admixing to a concentrate composition or blending with other constituents used to form a concentrate composition. Known art light stabilizer constituents may also be added, particularly wherein coloring agents are used in a composition. As is known to the art, such light stabilizers act to retain the appearance characteristics of the concentrate compositions over longer intervals of time.

Exemplary useful buffers include the alkali metal phosphates, polyphospates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use buffers such materials as aluminosilicates (zeolites), borates, aluminates and certain organic materials such as gluconates, succinates, maleates, and their alkali metal salts. Such buffers keep the pH ranges of the compositions of the present invention within acceptable limits.

Exemplary useful pH adjusting agents include known materials which may be used to adjust the pH of the concentrate compositions to a desired range.

The useful optional nonionic surfactants, include known art nonionic surfactant compounds. Practically any hydrophobic compound having a carboxy, hydroxy, amido, or amino group with a free hydrogen attached to the nitrogen can be condensed with ethylene oxide or with the polyhydration product thereof, polyethylene glycol, to form a water soluble nonionic surfactant compound. Further, the length of the polyethylenoxy hydrophobic and hydrophilic elements may various. Exemplary nonionic compounds include the polyoxyethylene ethers of alkyl aromatic hydroxy compounds, e.g., alkylated polyoxyethylene phenols, polyoxyethylene ethers of long chain aliphatic alcohols, the polyoxyethylene ethers of hydrophobic propylene oxide polymers, and the higher alkyl amine oxides.

To be mentioned as particularly useful nonionic surfactants are alkoxylated linear primary and secondary alcohols such as those commercially available under the tradenames PolyTergent® SL series (Olin Chemical Co., Stamford Conn.), Neodol® series (Shell Chemical Co., Houston Tex.); as alkoxylated alkyl phenols including those commercially available under the tradename Triton® X series (Union Carbide Chem. Co., Danbury Conn.).

Further exemplary useful nonionic surfactants which may be used include certain alkanolamides including monoethanolamides and diethanolamides, particularly fatty monoalkanolamides and fatty dialkanolamides. Commercially available monoethanol amides and diethanol amides include those marketed under the trade names Alakamide® and Cyclomide® by Rhône-Poulenc Co., (Cranbury, N.J.).

Exemplary useful amphoteric surfactants include alkylbetaines, particularly those which may be represented by the following structural formula:

$$RN(CH_3)_2CH_2COO^-$$

wherein R is a straight or branched hydrocarbon chain which may include an aryl moiety, but is preferably a straight hydrocarbon chain containing from about 6 to 30 carbon atoms. Further exemplary useful amphoteric surfactants include amidoalkylbetaines, such as amidopropylbetaines which may be represented by the following structural formula:

$$RCONHCH_2CH_2CH_2N^+(CH_3)_2CH_2COO^-$$

wherein R is a straight or branched hydrocarbon chain which may include an aryl moiety, but is preferably a straight hydrocarbon chain containing from about 6 to 30 carbon atoms.

Particularly exemplary useful betaines include dodecyl dimethyl betaine, cetyl dimethyl betaine, dodecyl amidopropyldimethyl betaine, tetradecyldimethyl betaine, tetradecylamidopropyldimethyl betaine, and dodecyldimethylammonium hexanoate.

What is to be understood by the tenn "concentrate" and "concentrate composition" in this specification and claims is the pre-consumer dilution and composition of the cleaning composition which is the essentially the form of the product prepared for sale to the consumer or other end user. Such a consumer or other end user would then normally be expected to dilute the same with water to form a cleaning composition. It is to be understood however that nothing in this invention would bar its use as cleaning composition without any further dilution and it may be used in the concentrations in which it was prepared for sale. Similarly, what is to be understood by the term "cleaning compositions" are the water diluted compositions which are expected to be prepared by the consumer or other end user by mixing a measured amount of the "concentrate" with water in order to form an appropriately diluted cleaning composition which is suitable for use in cleaning applications, especially in the cleaning of hard surfaces.

It is also to be understood, that proportions of one or more constituents have been and generally are referred to as percent by weight or as parts by weight based on a measure of 100% by weight, unless otherwise indicated.

According to certain particularly preferred embodiments of the invention there are provided aqueous concentrated liquid disinfectant composition which comprise (and in particularly preferred embodiments, consist essentially of) the following constituents:

1–10% wt. of botanical oil constituent;

0.5–6% wt. of a germicide, preferably a quaternary ammonium compound having germicidal properties;

0.1–35% wt. of an organic solvent constituent;

1–20% wt. of a botanical oil solubilizing constituent;

1–5% wt. of an amine oxide, alkylpolyoxycarboxylate or alkylarylpolyoxycarboxylate;

optionally but desirably up to 20% wt. of at least one optional constituent selected from: chelating agents, coloring agent, light stabilizers, fragrances, thickening agents, hydrotropes, pH adjusting agents, pH buffers one or more detersive surfactant constituents particularly non-ionic and amphoteric surfactants other than the amine oxides, alkylpolyoxycarboxylates or alkylarylpolyoxycarboxylates, as well as others known the art, with the proviso that the concentrate compositions do not include pine oil.

According to certain particularly preferred embodiments, the concentrate compositions also include a biphenyl solvent in the preferred amounts indicated above.

As generally denoted above, the formulations according to the invention include both cleaning compositions and concentrates as outlined above which differ only in the relative proportion of water to that of the other constituents forming such formulations. While the concentrated form of the cleaning compositions find use in their original form, they are more frequently used in the formation of a cleaning composition therefrom. Such may be easily prepared by diluting measured amounts of the concentrate compositions in water by the consumer or other end user in certain weight ratios of concentrate:water, and optionally, agitating the same to ensure even distribution of the concentrate in the water. As noted, the concentrate may be used without dilution, i.e., in concentrate:water concentrations of 1:0, to extremely dilute dilutions such as 1:10,000. Desirably, the concentrate is diluted in the range of 1:0.1–1:1000, preferably in the range of 1:1–1:500 but most preferably in the range of 1:10–1:100. The actual dilution selected is in part determinable by the degree and amount of dirt and grime to be removed from a surface(s), the amount of mechanical force imparted to remove the same, as well as the observed efficacy of a particular dilution. Generally better results and faster removal is to be expected at lower relative dilutions of the concentrate in water.

In accordance with preferred embodiments of the invention, when a quantity of the concentrate compositions taught herein are added to a larger volume of water, a blooming characteristic is manifested. Such "blooming" may be broadly characterized as the formation of milky, creamy or cloudy appearance which is manifested when a dilutable composition is added to a larger volume or quantity of water. Such "blooming" may be alternately characterized as the reduction of transmitted light through an amount of water by at least 30%, desirably by at least 40%, yet more desirably by at least about 50%, and yet most desirably by at least 60% or more when a dilution of the concentrate composition:water with the weight or volume ratio range of from 1:64–102 is formed. That such blooming may be attained without the use of pine oil such is are commonly found in certain commercially available pine oil containing preparations is very surprising.

As has been noted, concentrate compositions according to preferred embodiments of the invention exhibit a long lasting blooming effect when they are diluted into a larger volume of water, especially when used to form (weight ratio) dilutions with water of concentrate:water of 1:64 at room temperature. Desirably, such dilutions do not exhibit an increase in light transmittance in accordance with the measurement methods discussed in the Examples below, of more than 50% (based on the initial 'as mixed' value) during its initial three-day interval.

The concentrate compositions according to the invention, and aqueous dilutions formed therefrom, are particularly useful in the sanitization of hard surfaces. By way of non-limiting example, hard surfaces include surfaces composed of refractory materials such as: glazed and unglazed tile, brick, porcelain, ceramics as well as stone including marble, granite, and other stones surfaces; glass; metals; plastics e.g. polyester, vinyl; fiberglass, Formica®, Corian® and other hard surfaces known to the art. Hard surfaces which are to be particularly denoted include those associated with kitchen environments, lavatory environments, especially flooring surfaces and the surfaces of fixtures (doors, cabinets, shelving, and the like) in such environments.

The compositions according to the invention exhibit sanitizing properties, and are useful in the sanitization of surfaces wherein the presence of various viruses, molds, fungi, bacteria, and mildew are suspected.

In preferred embodiments, aqueous dilutions of the concentrated aqueous liquid disinfectant compositions exhibit antimicrobial efficacy against at least one of the following bacteria: *Staphylococcus aureus, Salmonella choleraesuis, Pseudomonas aeruginosa*, where the ratio of concentrate composition:water is 1:64 to 1:102. According to more preferred embodiments, aqueous dilutions of the concentrated aqueous liquid disinfectant compositions exhibit antimicrobial efficacy against at least two of the following bacteria: *Staphylococcus aureus, Salmonella choleraesuis, Pseudomonas aeruginosa*, where the ratio of concentrate composition:water of 1:64 to 1:102. Such aqueous dilutions may be classified as "broad spectrum disinfectant" compositions. According to a still more preferred embodiment, aqueous dilutions of the concentrated aqueous liquid disinfectant compositions exhibit antimicrobial efficacy against all three of the following bacteria: *Staphylococcus aureus, Salmonella choleraesuis, Pseudomonas aeruginosa*, where the ratio of concentrate composition:water of 1:64 to 1:102. Such aqueous dilutions may be classified as "hospital strength disinfectant" compositions. In each of these respective preferred, more preferred and still more preferred embodiments described immediately above, those which exhibit antimicrobial efficacy at greater aqueous dilutions of the concentrated aqueous liquid disinfectant compositions in water, such as at concentrate:water dilution ratios ratios of 1:102, are preferred over concenitrate:water dilution ratios of 1:85, and still more preferred over concentrate:water dilution ratios of 1:64.

Such dilution ratios of concentrate:water as described above may be volume/volume basis, or a weight/weight basis.

The following examples below illustrate exemplary and among them preferred formulations of the composition according to the instant invention. It is to be understood that these examples are presented by means of illustration only and that further useful formulations fall within the scope of this invention and the claims may be readily produced by one skilled in the art and not deviate from the scope and spirit of the invention.

EXAMPLES

A number of formulations were produced by mixing the constituents outlined in Table 1 by adding the individual constituents into a beaker of deionized water at room temperature which was stirred with a conventional magnetic stirring rod. The order of addition is not critical, but good results are obtained where the surfactants are added to the water prior to the remaining constituents. Stirring continued until the formulation was homogenous in appearance. It is to be noted that the constituents might be added in any order, but it is preferred that water be the initial constituent provided to a mixing vessel or apparatus as it is the major constituent and addition of the further constituents thereto is convenient. The exact compositions of the example formulations are listed on Table 1, below.

TABLE 1

| | Ex.1 | Ex.2 | Ex.3 | Ex.4 | Ex.5 |
|---|---|---|---|---|---|
| lavender oil | 8.0 | — | — | — | — |
| peppermint oil | — | 8.0 | 8.0 | 8.0 | 8.15 |
| quaternary ammonium compound (80%) | 8.0 | 8.0 | 0.5 | 0.5 | 7.85 |
| isopropyl alcohol | 12.0 | 12.0 | 12.0 | 12.0 | 12.0 |
| propylene glycol | 20.0 | 20.0 | 20.0 | 20.0 | 20.0 |
| lauryl alcohol | 1.0 | 1.0 | 1.0 | 1.0 | 1.0 |
| biphenyl solvent | 1.0 | 1.0 | 1.0 | 1.0 | 1.0 |
| amine oxide (50%) | — | — | 14.0 | 14.0 | — |
| alkylpoloxycarboxlate | — | — | 0.5 | — | — |
| Na2EDTA | 0.5 | 0.5 | — | — | — |
| EDTA | — | — | 0.5 | 0.5 | 0.5 |
| di water | to 100 | to 100 | to 100 | to 100 | to 100 |

The identity of the specific constituents used to produce the fomnulations according to Table 1 are listed on Table 2, below:

TABLE 2

| | |
|---|---|
| lavender oil | proprietary composition (Berje Co., Bloomfield, NJ) |
| peppermint oil | proprietary composition (Berje Co., Bloomfield, NJ) |
| quaternary ammonium compound (80%) | BTC 8358, alkyl dimethyl benzyl ammonium chloride (Stepan Corp, Northfield, IL), 80% wt. actives |
| isopropyl alcohol | technical grade, 100% wt. (Eastman Chemical Corp.) |
| propylene glycol | technical grade, 100% wt. (Eastman Chemical Corp.) |
| lauryl alcohol | technical grade mixture of 67–75% wt. 1-dodecanol, 22–28% wt. 1-tetradecanol, 4–8% wt. 1-hexadecanol, and 0–0.5% wt. 1-decanol (Henkel Corp.) |
| biphenyl solvent | NUSOLV ABP-103 (Ridge Technologies Inc., Ridgewood NJ) |
| amine oxide (50%) | TOMAH AO-728 special was bis-(2-hydroxyethyl C12–C15 alkyloxypropyl) amine oxide (Tomah Products Inc., Milton WI), 50% wt. actives |
| alkylpolyoxycarboxlate | carboxlated alcohol, as EMCOL CNP 100 (Witco Chem. Co.), 100% wt. actives |
| Na2EDTA | disodium salt of ethylenediamine tetraacetic acid, sold as VERSENE Na2 crystal (Dow Chem. Co.) |
| EDTA | ethylenediaminetetraacetic acid, sold as VERSENE Acid (Dow Chem. Co.) |
| di water | deionized water |

All of the formulations on Table 1 indicated in weight percent, and the percent actives of individual constituents are 100% unless otherwise indicated.

The blooming characteristics of these formulations was characterized by using the Brinkman Sybron PC 801 colorimeter. Each tested formulation were diluted with deionised water in a weight ratio of 1:64, and the test was carried out with each of the formulations and water at room temperature (68° F, 20° C.). The resulting determined values, reported as "blooming" in the following table provide an empirical evaluation in percent transmittance (%) of the degree of transparency of a diluted example formulation wherein 0% indicates complete opacity and 100% the transparency of a deionised water sample. The result was tabulated on Table 3:

TABLE 3

| | % Transmittance |
|---|---|
| Comp.1 | 0.5 |
| Ex.1 | 8.1 |
| Ex.2 | 7.6 |
| Ex.3 | 1.6 |

TABLE 3-continued

| | % Transmittance |
|---|---|
| Ex.4 | 1.5 |
| Ex.5 | 7.9 |

Comparative 1 (Comp.1) was DETTOL (Reckiff & Colman PLC, Hull, UK), a soap based, blooming type disinfecting concentrate composition which does not include biphenyl solvents. DETTOL has a particularly substantive bloom and is used as a 'benchmark' for other formulations.

As may be seen from the results indicated on Table 3, the formulations according to the invention based on the botanical oil constituent provided very satisfactory blooming.

Cleaning Test:

Cleaning efficacy was measured for weight ratios of 1:64 (concentrate composition:water) aqueous dilutions of formulations according to Ex.1 and Ex.2 and as a control, the formulation according to Comp.1 described above. The test was carried out using the ASTM D4488-89, Annex A2 method—greasy soil on painted masonite wallboard test, using a Gardner Washability Apparatus.

Latex painted masonite wallboard is soiled with a mixture of melted, oily soils containing a small amount of carbon black and allowed to set overnight. A first aqueous dilution is applied to a sponge that scrubs half the soiled substrate in a straight-line using the Gardner Washability Apparatus. Afterwards, the second aqueous dilution is applied to a further sponge that scrubs the other half of the soiled substrate in a similar manner.

In determining the cleaning efficiency, reflectance values were determined using a Gardner Lab Scan Reflectometer for each of the following: a clean unsoiled panel, a soiled panel, and a soiled panel following Gardner Washability Apparatus scrubbing. Such reflectance values were then employed to calculate % cleaning efficiency according to the following formula:

$$\%\ \text{Cleaning Efficiency} = \frac{Lt - Ls}{Lo - Ls} \times 100\%$$

wherein,

Lt=% reflectance average after scribbing solid tile

Ls=% reflectance average before cleaning soiled tile

Lo=% reflectance average original tile before soiling

Cleaning efficiency results for Formulation 1 are shown in TABLE 4, hereinafter.

TABLE 4

| Formulation:water (1:64) w/w dilution | % Cleaning Efficiency |
|---|---|
| DETTOL | 42.8 |
| Ex.1 | 44.6 |
| Ex.2 | 43.9 |

As a comparative example, a dilution was also formed from DETTOL, described above.

As shown, the measurement of the cleaning effectiveness of the test samples involved the ability of the cleaning composition to remove the test soil from the test substrate. This was expressed by % Cleaning Efficiency. As numerical values for a % Cleaning Efficiency increase, higher cleaning effectiveness is achieved for the cleaning composition tested. As the results show, the inventive composition showed an excellent cleaning property.

Antimicrobial Evaluation:

A modified European suspension test was carried out for formulations according to Examples 1 and 2 described above and as a comparative example, DETTOL (Reckitt & Colman PLC, England) a concentrated cleaning and disinfecting composition described previously. The method is summarized as follow.

1) Pipette 8 ml of the test product dilution into sterile medicant tube and held at 20C+1C in water bath.
2) In another sterile medicant tube pipette 1.0 ml of adjusted culture and 1.0 ml of prepared Bovine Albumin Solution and held at 20C+1C in water bath.
3) At time=0 minutes add product solution into medicant tube containing a mixture of Bovine Albumin Solution and culture suspension of each test organism. This mixture results in a final dilution of the test product, a concentration of 0.03% of Bovine Albumin Solution and bacterial count of at least $1–3\times10^7$ CFU/ml.
4) At time=5 minutes, pipette 1 ml of this mixture into 9 ml of neutralizing solution (letheen broth) so as to achieve 1:10 dilution. Prepare serial dilution in Letheen broth and place with Tryticase soy with lecithin and Tween 80 agar in duplicate.

Control: The procedure as outlined above was repeated, using 8 ml of sterile water instead of product dilution for each test organism.

To pass the test method, it was required that the tested formulations satisfied a 5 log reduction in reference bacterial strain of *S.aureus* (ATTC #5438), *Ps.aeruginosa* (ATTC #15442), *Escherichia coli* (ATTC #10536), with 5 minutes contact time at 20° C.+1° C. under defined testing method. It was found that each of the formulations according to Ex.1 and Ex.2 showed reduction of the test organisms at the testing contact time. The testing requirements indicate a (great than) ">5" log reduction within 5 minutes. It was concluded that formulations according to Ex. 1 and 2 have at least the same microbial activity as DETTOL.

What is claimed is:

1. An aqueous concentrated liquid disinfectant composition which blooms when added to a larger volume of water which comprises the following constituents:

from 0.001% to 20% wt. of a botanical oil constituent;

from 0.001% to about 15% wt. of a germicidal cationic surfacant having germicidal properties;

from about 0.001% to about 50% wt. of an organic solvent constituent;

at least one botanical oil solubilizing surfactant, selected from amine oxides present in an amount of from about 0.001% to about 30% wt., alkylpolyoxycarboxylates and alkylarylpolyoxycarboxylates present in an amount of from about 0.001% to about 20% wt.;

from about 0.001 to about 10% wt. of a biphenyl solvent constituent having the formula;

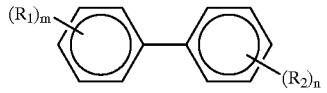

wherein:

$R_1$ is hydrogen or a straight chained or branched $C_1–C_{10}$ radical, $R_2$ is a straight chained or branched $C_1–C_{10}$ radical, m is an integer from 1–3 inclusive; and, n is an integer from 1–3 inclusive, optionally one or more constituents selected from: chelating agents, coloring agents, light stabilizers, fragrances, thickening agents, hydrotropes, pH adjusting agents, pH buffers and one or more detersive surfactant constituents, characterized in that the composition does not contain pine oil.

2. The composition according to claim 1 wherein the botanical oil constituent is selected from lavender oil and peppermint oil.

3. The composition according to claim 1 wherein the germicidal cationic surfactant is a quaternary ammonium compound having germicidal properties.

4. The composition according to claim 1 wherein the organic solvent constituent is selected from isopropyl alcohol, lauryl alcohol, propylene glycol, and mixtures thereof.

5. An aqueous dilution of the composition according to claim 1 in a larger volume of water.

6. A process for the cleaning of hard surfaces which comprises the process step of:

applying a cleaning effective amount of the composition according to claim 1 to a hard surface.

7. A process for the sanitization of hard surfaces which comprises the process step of:

applying a sanitizing effective amount of the composition according to claim 1 to a hard surface.

8. The composition according to claim 1 wherein the germidical cationic surfactant having germicidal properties is a quaternary ammonium compound or salt thereof, which may be characterized by the general structural formula:

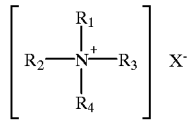

wherein at least one of $R_1$, $R_2$, $R_3$ and $R_4$ is a alkyl, aryl or alkylaryl substituent of from 6 to 26 carbon atoms, and X may be any salt-lorminig anion.

9. The composition according to claim 8 wherein the quaternary ammonium compound or salt thereof is one according to the structural formula:

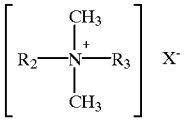

wherein:

$R_2$ and $R_3$ are the same or different $C_8$–$C_{12}$alkyl, or $R_2$ is $C_{12-16}$alkyl, $C_{8-18}$alkylethoxy. $C_{8-18}$alkylphenolethoxy and $R_3$ is benzyl, and X is a halide.

10. The composition according to claim 1 wherein the botanical oil constituent is one or more of: Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Canaga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methhyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), and Wintergreen.

11. The composition according to claim 1 wherein the alkylpolyoxycarboxylate is one according to the general formula:

$$R—[—OCH_2CH_2—]_n—CH_2COO^-M^+$$

wherein:

R is a straighit chained or branched hydrocarbon chain which may include an aryl moiety, n is an integer value of from 1–24, and M is a metal or ammonium ion.

12. The composition according to claim 1 wherein the alkyl biphenyl may be generally represented by the formula

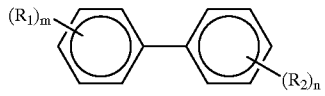

wherein:

$R_1$ is hydrogen or is a $C_1$–$C_6$ straight chained or branched alkyl radical, $R_2$ is a $C_1$–$C_6$ straight chained or branched alkyl radical, m is an integer from 1–3 inclusive; and, n is an integer from 1–3 inclusive.

13. The composition according to claim 1, wherein the one or more optional detersive surfactant constituents are selected from the group consisting of nonionic surfactants and amphoteric surfactants.

* * * * *